US011217943B2

(12) United States Patent
Maesoba et al.

(10) Patent No.: US 11,217,943 B2
(45) Date of Patent: Jan. 4, 2022

(54) SHIELD TERMINAL INCLUDING STRUCTURES HAVING DIFFERENT DIELECTRIC CONSTANTS

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP); Kazuhiro Yoshida, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/769,076

(22) PCT Filed: Dec. 3, 2018

(86) PCT No.: PCT/JP2018/044404
§ 371 (c)(1),
(2) Date: Jun. 2, 2020

(87) PCT Pub. No.: WO2019/124035
PCT Pub. Date: Jun. 27, 2019

(65) Prior Publication Data

US 2021/0234311 A1 Jul. 29, 2021

Related U.S. Application Data

(63) Continuation of application No. PCT/JP2018/044404, filed on Dec. 3, 2018.

(30) Foreign Application Priority Data

Dec. 21, 2017 (JP) ..... JP2017-245115

(51) Int. Cl.
*H01R 13/6581* (2011.01)
*H01R 13/11* (2006.01)
(Continued)

(52) U.S. Cl.
CPC ..... *H01R 13/6581* (2013.01); *H01R 13/111* (2013.01); *H01R 13/502* (2013.01);
(Continued)

(58) Field of Classification Search
CPC H01R 13/6581; H01R 13/111; H01R 13/502; H01R 13/639; H01R 13/6598; H01R 2201/26
(Continued)

(56) References Cited

U.S. PATENT DOCUMENTS 4,973,268 A * 11/1990 Smith ..... H01R 13/4365 439/589
5,281,168 A * 1/1994 Krehbiel ..... H01R 13/4362 439/595
(Continued)

FOREIGN PATENT DOCUMENTS

JP 08-007995 1/1996
JP 09-161895 6/1997
(Continued)

OTHER PUBLICATIONS

Official Communication issued in International Bureau of WIPO Patent Application No. PCT/JP2018/044404, dated Feb. 19, 2019.

*Primary Examiner* — Peter G Leigh
(74) *Attorney, Agent, or Firm* — Greenblum & Bernstein, P.L.C.

(57) ABSTRACT

A shield terminal is provided with a pair of female inner conductors including box-shaped connecting portions into
(Continued)

which tabs of male inner conductors are inserted, a female dielectric configured by uniting a first member and a second member made of a material having a lower dielectric constant than the first member, the pair of female inner conductors being accommodated in the female dielectric while being arranged in parallel, and a front separation wall portion formed in the second member and disposed to partition between a pair of the box-shaped connecting portions. Since the female dielectric is divided into the first member and the second member and the front separation wall portion is formed in the second member having a lower dielectric constant, a material cost can be reduced as compared to the case where the both members are made of a material having a low dielectric constant.

11 Claims, 9 Drawing Sheets

(51) Int. Cl.
*H01R 13/502* (2006.01)
*H01R 13/639* (2006.01)
*H01R 13/6598* (2011.01)

(52) U.S. Cl.
CPC ..... *H01R 13/639* (2013.01); *H01R 13/6598* (2013.01); *H01R 2201/26* (2013.01)

(58) Field of Classification Search
USPC ..... 439/607.01
See application file for complete search history.

(56) References Cited

U.S. PATENT DOCUMENTS 5,466,175 A * 11/1995 Onoda ..... H01R 9/0518 439/607.48
5,518,428 A * 5/1996 Onoda ..... H01R 13/4223 439/595
5,575,683 A * 11/1996 Saito ..... H01R 13/4365 439/595
5,575,692 A * 11/1996 Cecil, Jr. ..... H01R 13/4368 439/752
6,045,404 A * 4/2000 Myer ..... H01R 13/4223 439/595
6,126,484 A * 10/2000 Klein ..... H01R 13/4223 439/157
6,599,150 B1 * 7/2003 Martin ..... H01R 13/4364 439/595
7,008,254 B2 * 3/2006 Matsunaga ..... H01R 13/4223 439/352
8,764,486 B2 * 7/2014 Ii ..... H01R 9/038 439/607.46
8,771,016 B2 * 7/2014 Atkinson ..... H01R 13/6474 439/607.07
8,814,595 B2 * 8/2014 Cohen ..... H01R 13/04 439/607.07
8,870,596 B2 * 10/2014 Ii ..... H01R 13/6581 439/607.41
8,992,257 B2 * 3/2015 Ii ..... H01R 13/59 439/607.41
9,028,281 B2 * 5/2015 Kirk ..... H01R 12/724 439/701
9,380,710 B2 * 6/2016 Schumacher ..... H01R 24/64
9,543,707 B2 * 1/2017 Miyoshi ..... H01R 13/502
9,865,970 B2 * 1/2018 Abe ..... H01R 4/185
2009/0221190 A1 * 9/2009 Ambo ..... H01R 13/516 439/701
2013/0012038 A1 * 1/2013 Kirk ..... H01R 12/721 439/55
2013/0017733 A1 * 1/2013 Kirk ..... H01R 12/721 439/676
2013/0023154 A1 * 1/2013 Ii ..... H01R 13/65918 439/607.5
2013/0023155 A1 * 1/2013 Ii ..... H01R 13/6593 439/607.27
2013/0288523 A1 * 10/2013 Ii ..... H01R 13/6581 439/607.01
2016/0072203 A1 * 3/2016 Ii ..... H01R 13/113 439/816
2016/0365674 A1 * 12/2016 Abe ..... H01R 43/18
2018/0102597 A1 4/2018 Maesoba et al.

FOREIGN PATENT DOCUMENTS

JP 2005-347191 12/2005
JP 2012-129103 7/2012
JP 2014-232682 12/2014
JP 2017-004853 1/2017
JP 2018-063796 4/2018

* cited by examiner

SHIELD TERMINAL INCLUDING STRUCTURES HAVING DIFFERENT DIELECTRIC CONSTANTS

TECHNICAL FIELD

The present invention relates to a shield terminal.

BACKGROUND ART

Patent literature 1 discloses a connector provided with a female shield terminal accommodating a pair of female inner conductors connected to a twisted pair cable in a female dielectric and a male shield terminal having a pair of male inner conductors mounted on a male dielectric. In the shield terminal of this type, a separation wall portion formed in the dielectric is interposed between the pair of inner conductors as a means for insulating the pair of inner conductors.

PRIOR ART DOCUMENT

Patent Document

[Patent Document 1]
Japanese Unexamined Patent Publication No. 2012-129103

SUMMARY OF THE INVENTION

Problem the Invention Seeks to Solve

If the female shield terminal and the male shield terminal are connected, tabs of the male inner conductors are inserted into box-shaped connecting portions of the female inner conductors, whereby the both male and female inner conductors are connected. Since metals overlap in a part in which the tab is inserted in the box-shaped connecting portion, an impedance is lower than other parts (connected part of each inner conductor to a wire and the like). It is considered to reduce a dielectric constant of the separation wall portion interposed between the pair of box-shaped connecting portions as a means for matching an impedance of a connected part of the box-shaped connecting portion and the tab with an impedance of the other parts. However, since a resin material having a low dielectric constant and a sufficient strength is generally expensive, a material cost increases if the entire female dielectric is made of a resin material having a low dielectric constant and a high mechanical strength.

The present invention was completed on the basis of the above situation and aims to realize a cost reduction and ensure strength.

Means for Solving the Problem

The present invention is directed to a shield terminal with a pair of female inner conductors including box-shaped connecting portions into which tabs of male inner conductors are inserted, a female dielectric configured by uniting a first member and a second member made of a material having a lower dielectric constant than the first member, the pair of female inner conductors being accommodated in the female dielectric while being arranged in parallel, and a separation wall portion formed in the second member, the separation wall portion being disposed to partition between a pair of the box-shaped connecting portions.

Effects of Invention

The female dielectric is divided into the first and second members having different dielectric constants, and the separation wall portion is formed in the second member having a lower dielectric constant. Since a resin material having a low dielectric constant and a low mechanical strength is relatively inexpensive, a material cost can be reduced as compared to the case where the second member is made of a resin material having a low dielectric constant and a high mechanical strength. Further, since a resin material having a high dielectric constant generally has a relatively high mechanical strength, the strength of the entire female dielectric is ensured by using the first member having a higher dielectric constant than the second member. Therefore, if the first member is formed with a part requiring a mechanical strength like a part for holding the female inner conductors, the female inner conductors can be reliably held.

EMBODIMENTS OF THE INVENTION

Figure 1:
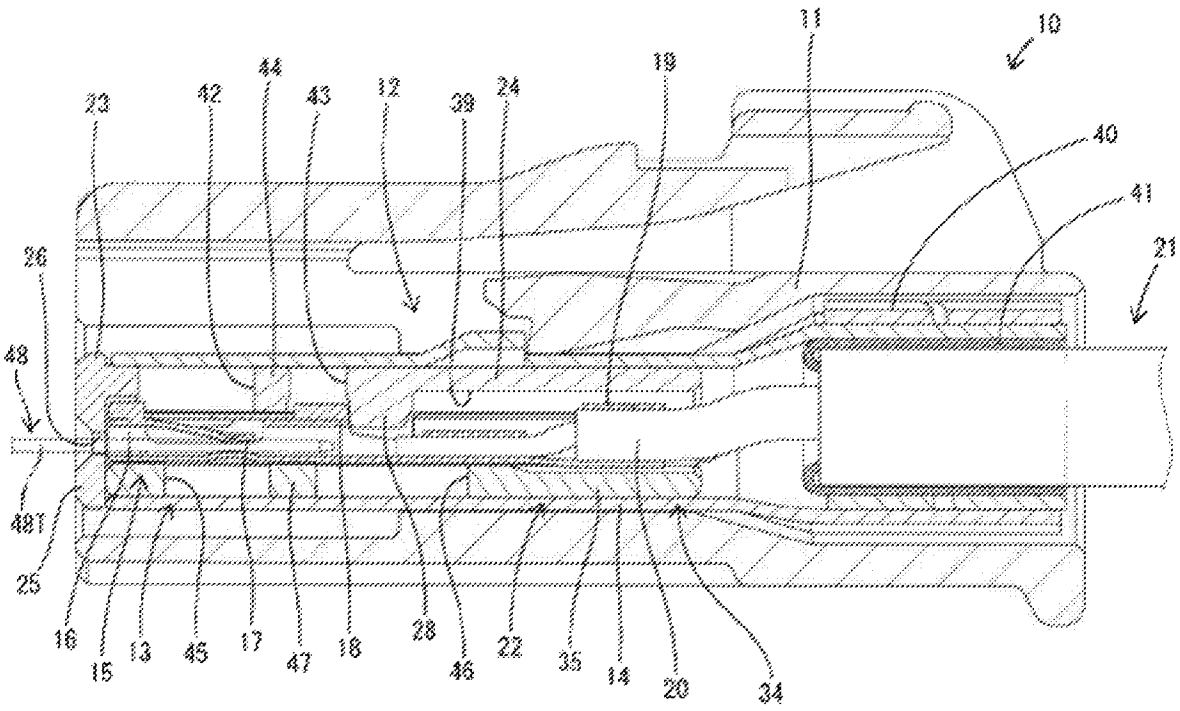
FIG. 1 is a section showing a state where a shield terminal of one embodiment is mounted in a housing.

The present invention may be such that the separation wall portion is cantilevered from a base plate portion constituting the second member, and the first member is formed with a receiving groove into which an extending end part of the separation wall portion is fit.

Since a material having a low dielectric constant generally has a low mechanical strength, there is a concern for the deformation of the separation wall portion due to interference with the female inner conductors. However, improper deformation of the separation wall portion can be prevented by fitting the extending end part of the separation wall portion into the receiving groove formed in the first member having a relatively high mechanical strength. Further, since a creepage distance between the female inner conductors becomes longer by an area in which the outer surface of the separation wall portion and the inner surface of the receiving groove face each other, insulation performance is also excellent.

The present invention may be such that the separation wall portion extends in a uniting direction with the first member from a base plate portion constituting the second member, and the first member is formed with a guide groove to be brought into sliding contact with the separation wall portion in a process of uniting with the second member.

According to this configuration, improper deformation of the separation wall portion can be prevented by bringing the separation wall portion into sliding contact with the guide groove in the process of uniting the first and second members.

The present invention may be such that the separation wall portion is cantilevered in a uniting direction with the first member from a base plate portion constituting the second member and becomes gradually thinner in an extending direction.

According to this configuration, the interference of the separation wall portion with the box-shaped connecting portions can be avoided in the process of uniting the first and second members. Further, since air layers having a low dielectric constant are formed between the separation wall portion and the box-shaped connecting portions, impedances of the box-shaped connecting portions are enhanced.

The present invention may be such that the shield terminal includes ribs formed on the separation wall portion, the ribs projecting from surfaces of the separation wall portion facing the box-shaped connecting portions.

If the air layers are present between the separation wall portion and the box-shaped connecting portions, there is a concern that the female inner conductors are improperly inclined toward the separation wall portion. However, the inclination of the female inner conductors can be suppressed by the ribs. Further, the strength of the separation wall portion is enhanced by the ribs.

The present invention may be such that the shield terminal includes a front wall portion formed on the first member, the front wall portion including insertion openings through which the tabs are inserted.

The material of the first member has a higher dielectric constant than that of the second member and a resin material having a high dielectric constant has a relatively high mechanical strength. Even if the tab deviated in position from the insertion opening butts against the front wall portion, the tab is not pierced into the front wall portion since the front wall portion is formed on the first member having a high mechanical strength.

The present invention may be such that the shield terminal includes a locking portion formed on the first member, the locking portion holding the female dielectric and the outer conductor in an assembled state by being locked to the outer conductor.

The material of the first member has a higher dielectric constant than that of the second member and a resin material having a high dielectric constant has a relatively high mechanical strength. The locking portion formed on the first member having a high mechanical strength is not improperly deformed even if being locked to the outer conductor made of a metal material. Therefore, the female dielectric and the outer conductor can be reliably held in the assembled state.

Embodiment

Figure 2:
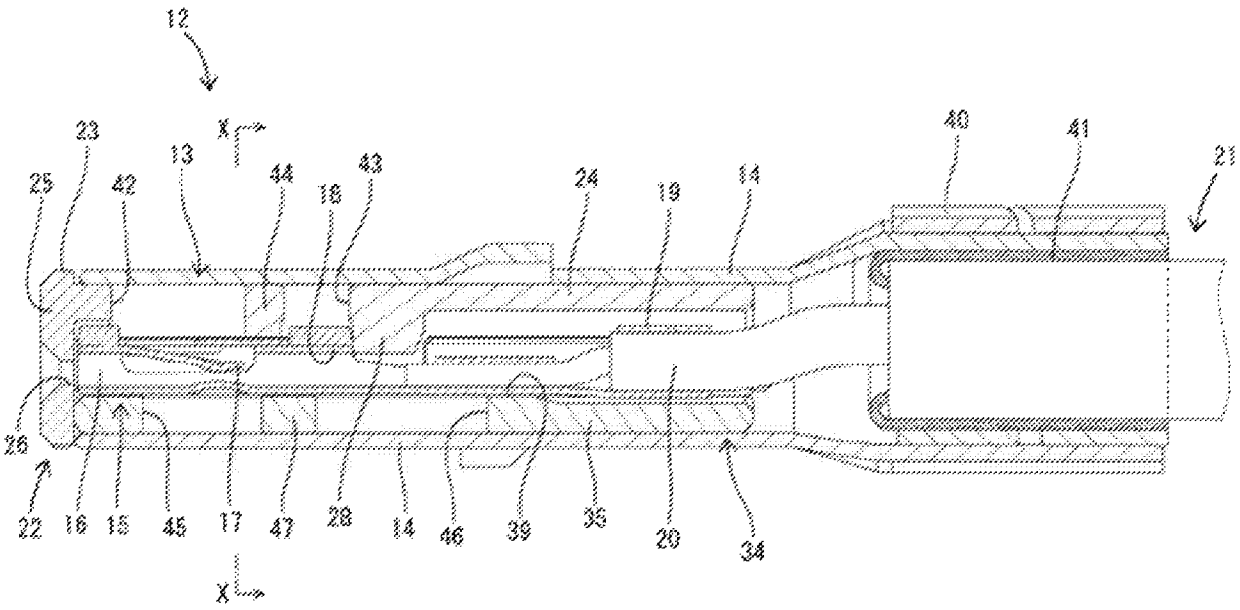
FIG. 2 is a section of the shield terminal.
Figure 3:
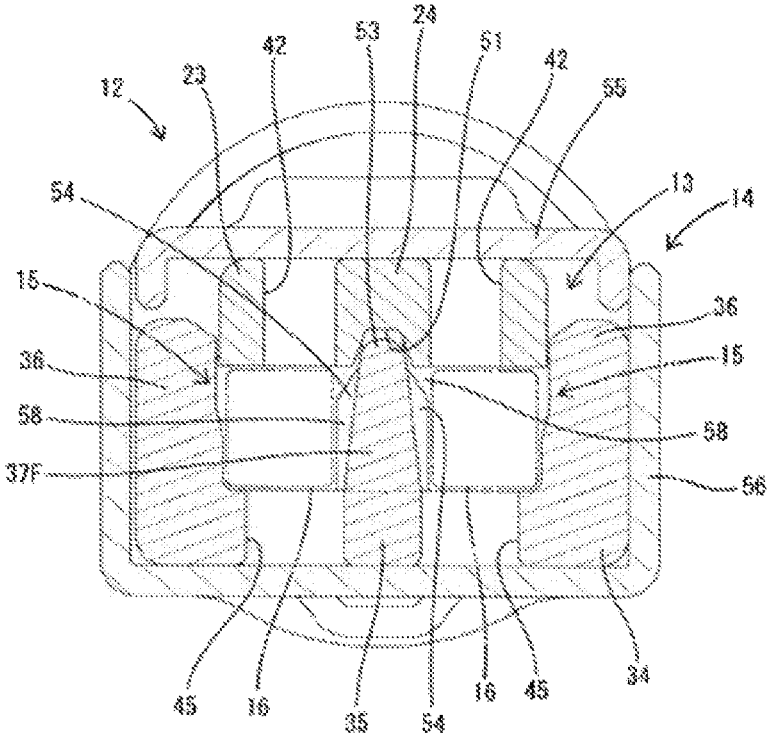
FIG. 3 is a section along X-X of FIG. 2.
Figure 4:
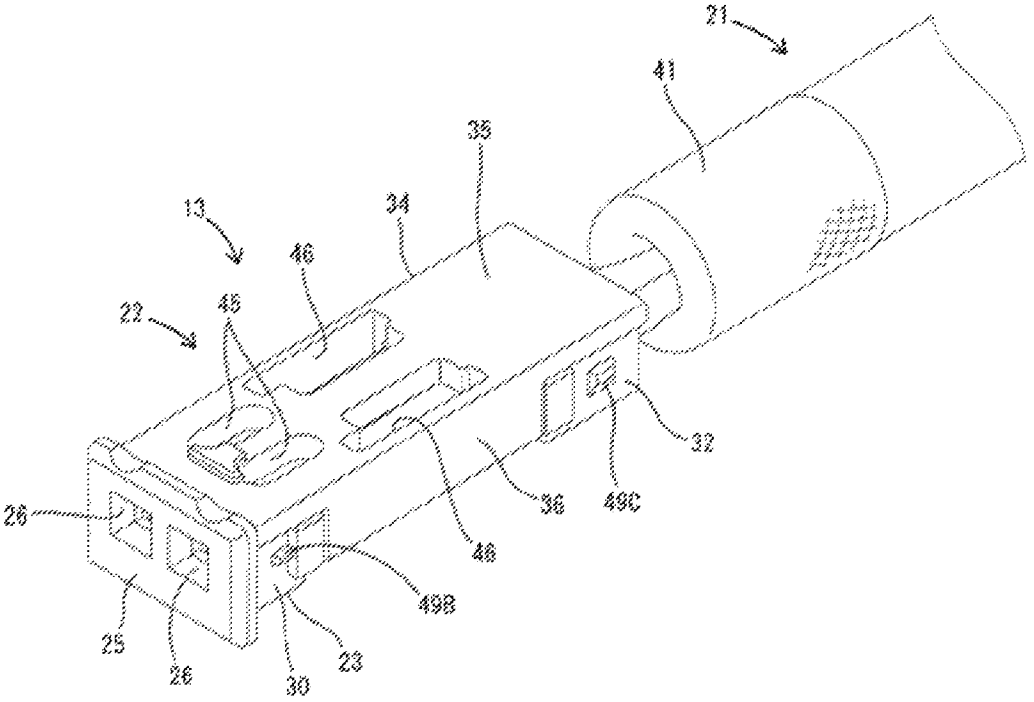
FIG. 4 is a perspective view showing a vertically inverted state of a terminal unit.
Figure 5:
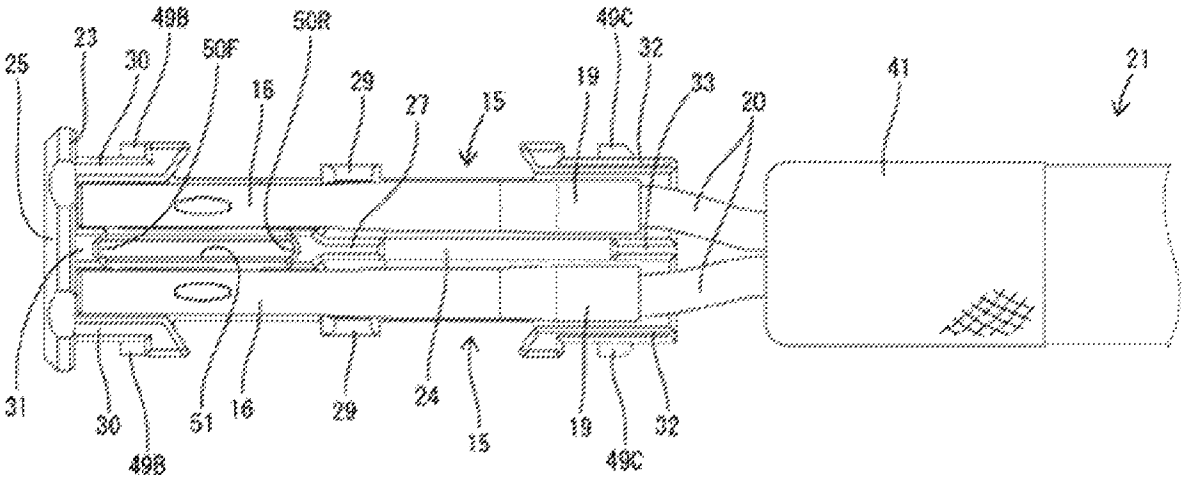
FIG. 5 is a bottom view showing a state where female inner conductors are mounted in a first member.
Figure 6:
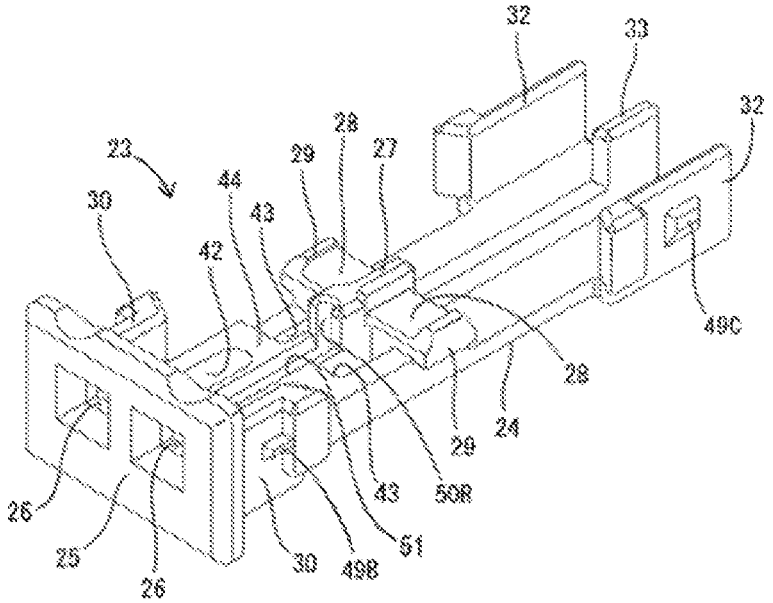
FIG. 6 is a perspective view showing a vertically inverted state of the first member.
Figure 7:
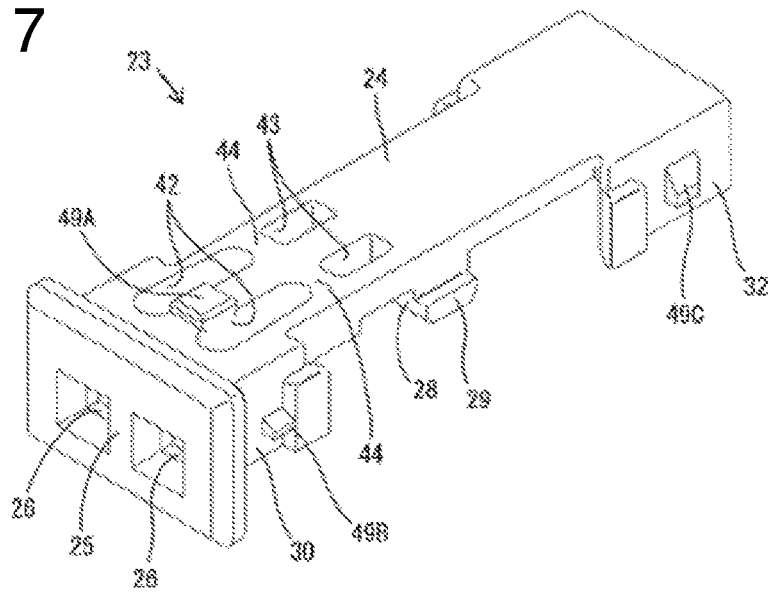
FIG. 7 is a perspective view of the first member.
Figure 8:
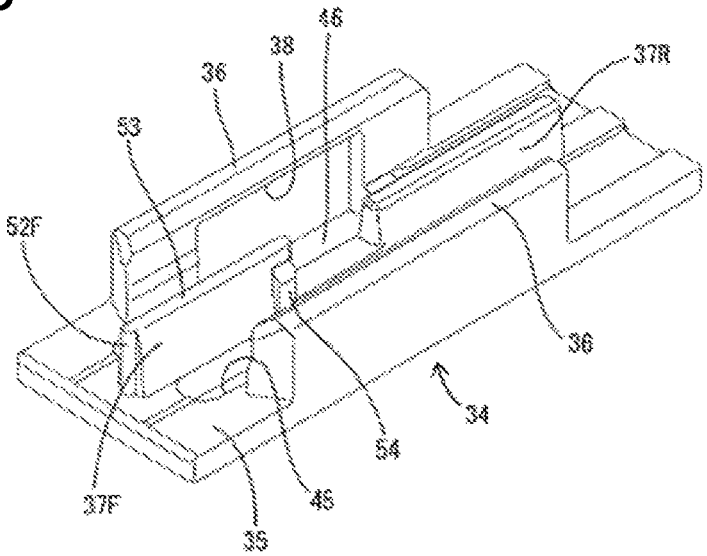
FIG. 8 is a perspective view of a second member.
Figure 9:
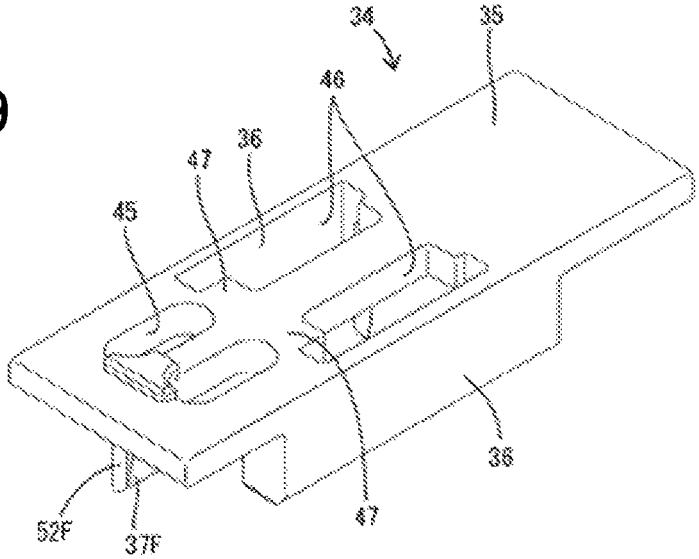
FIG. 9 is a perspective view showing a vertically inverted state of the second member.
Figure 10:
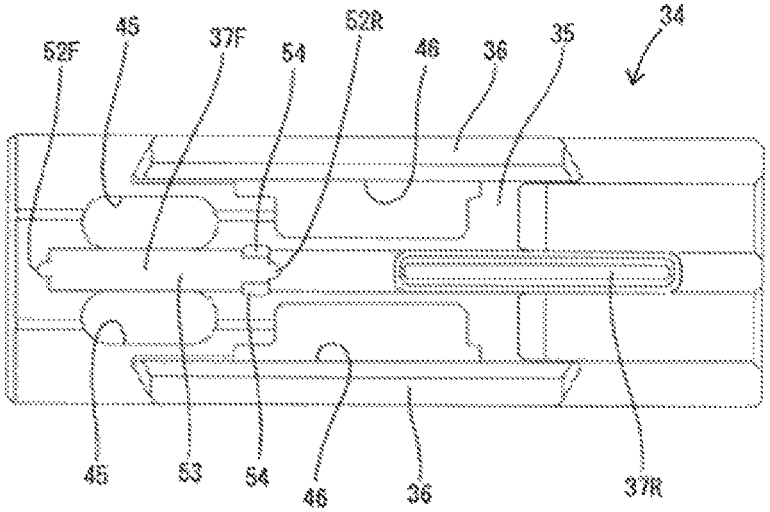
FIG. 10 is a plan view of the second member.
Figure 11:
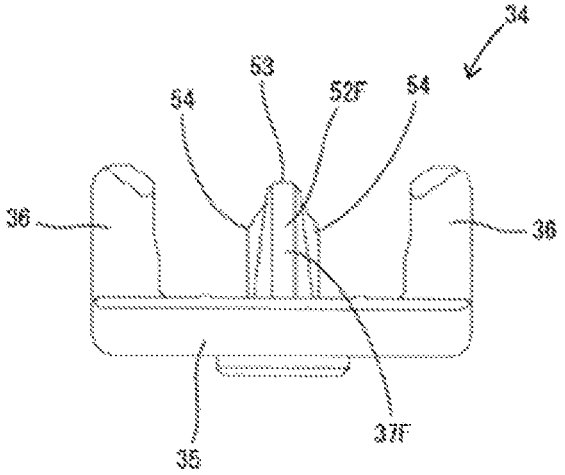
FIG. 11 is a front view of the second member.
Figure 12:
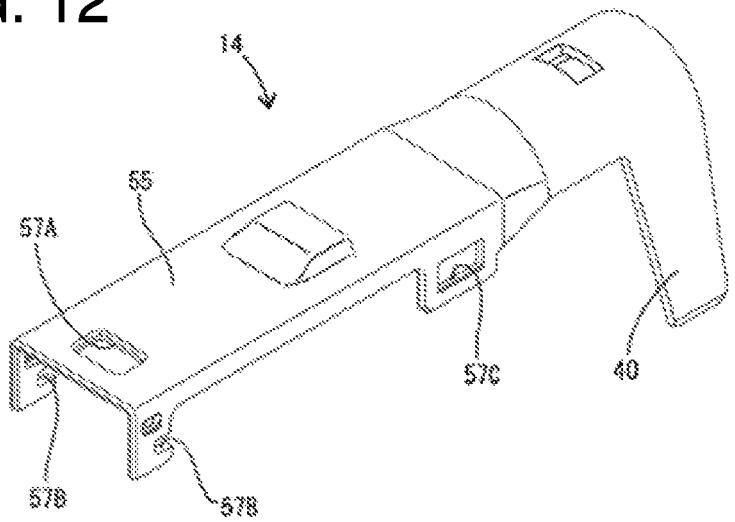
FIG. 12 is a perspective view of an upper shell.
Figure 13:
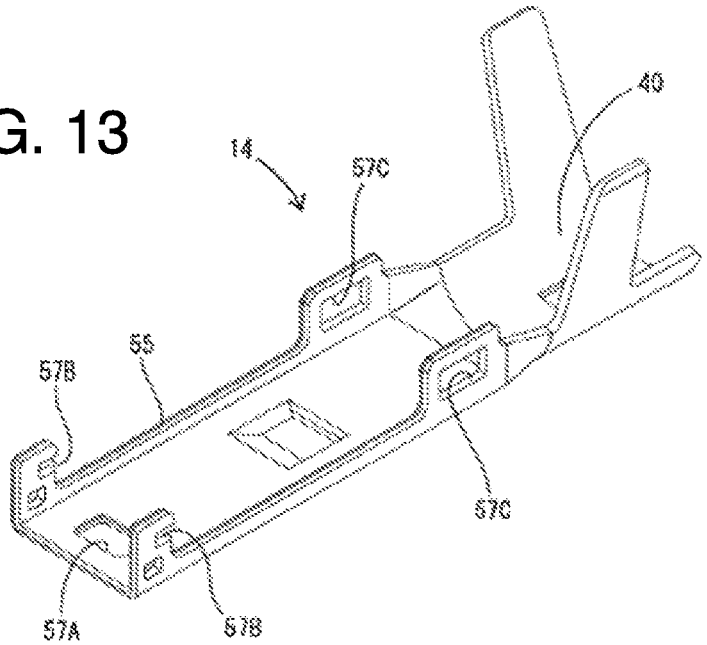
FIG. 13 is a perspective view showing a vertically inverted state of the upper shell.

Hereinafter, one specific embodiment of the present invention is described with reference to FIGS. 1 to 13. Note that, in the following description, a left side in FIGS. 1, 2, 4 to 10, 12 and 13 is defined as a front side concerning a front-rear direction. Upper and lower sides shown in FIGS. 1 to 3, 7, 8, 11 and 12 are directly defined as upper and lower sides concerning a vertical direction.

A shield connector 10 of this embodiment is a connecting member constituting a wiring harness for an Ethernet (registered trademark) high-speed communication circuit of an automotive vehicle and includes a housing 11 made of synthetic resin and a shield terminal 12 accommodated in the housing 11. The shield terminal 12 is configured by assembling a terminal unit 13 and an outer conductor 14. One terminal unit 13 is configured by accommodating a pair of female inner conductors 15 into a female dielectric 22.

<Female Inner Conductors 15>

The female inner conductor 15 is shaped to be elongated in the front-rear direction as a whole. A box-shaped connecting portion 16 in the form of a rectangular tube is formed in a front end part of the female inner conductor 15. An elongated tab 48T on the tip of a male inner conductor 48 is inserted into the box-shaped connecting portion 16 from front of the female inner conductor 15. The tab 48T inserted into the box-shaped connecting portion 16 resiliently contacts a resilient contact piece 17 formed in the box-shaped connecting portion 16, whereby the male inner conductor 48 and the female inner conductor 15 are conductively connected.

A step portion 18 is formed in a rear end part of the box-shaped connecting portion 16. A crimping portion 19 in the form of an open barrel is formed in a rear end part of the female inner conductor 15, and a front end part of a wire 20 is conductively fixed to the crimping portion 19. A pair of the wires 20 connected to the pair of female inner conductors 15 constitute a twisted pair cable 21.

<Female Dielectric 22>

The female dielectric 22 is configured by vertically uniting a first member 23 halved and made of synthetic resin and a second member 34 halved and made of synthetic resin. A uniting direction of the first and second members 23, 34 is a direction orthogonal to a length direction of the female inner conductors 15 elongated in the front-rear direction (axes of front end parts of the wires 20) and orthogonal to a lateral direction in which the pair of female inner conductors 15 are arranged. The first member 23 is made of polybutylene terephthalate (PBT) having a higher dielectric constant and a higher mechanical strength than the second member 34. The second member 34 is made of polypropylene (PP) having a lower dielectric constant and a lower mechanical strength than the first member 23.

<First Member 23>

The first member 23 is a single component made of synthetic resin. The first member 23 includes an upper wall portion 24 elongated in the front-rear direction and a front wall portion 25 extending downward from the front end edge of the upper wall portion 24. A pair of left and right insertion openings 26 through which the tabs 48T are inserted are formed to penetrate through the front wall portion 25.

The first member 23 is formed with a center partition wall 27 and a pair of left and right retaining portions 28. The center partition wall 27 extends downward from a laterally central position in a central part in the front-rear direction of the upper wall portion 24. The pair of left and right retaining portions 28 are formed by causing areas of the central part in the front-rear direction of the upper wall portion 24 connected to both left and right side surfaces of the center partition wall 27 to extend downward. Further, a pair of left and right lock projections 29 are formed on outer side surfaces of the pair of left and right retaining portions 28.

The first member 23 is formed with a pair of left and right front side walls 30 extending downward from front end parts of both left and right side edges of the upper wall portion 24 and a front partitioning portion 31 extending downward from a laterally central position of a front end part of the upper wall portion 24. The pair of front side walls 30 and the front partitioning portion 31 are connected to the rear surface of the front wall portion 25. The first member 23 is formed with a pair of left and right rear side walls 32 extending downward from rear end parts of the both left and right side edges of the upper wall portion 24 and a rear partition wall 33 extending downward from a laterally central position of a rear end part of the upper wall portion 24.

A projection-like first locking portion 49A (locking portion as claimed) is formed on an outer surface (upper surface) of the upper wall portion 24. Projection-like second locking portions 49B (locking portion as claimed) are formed on the outer side surfaces of the front side walls 30. Projection-like third locking portions 49C (locking portion as claimed) are formed on the outer side surfaces of the rear side walls 32. These locking portions 49A, 49B and 49C are locked to an upper shell 55 of the outer conductor 14 to be described later.

A front guide groove 50F (guide groove as claimed) extending in the vertical direction (direction parallel to the uniting direction of the first and second members 23, 34) is formed in the rear end surface of the front partitioning portion 31. A rear guide groove 50R (guide groove as claimed) extending in the vertical direction (parallel to the front guide groove 55F) is formed in the front end surface of the center partition wall 27.

A receiving groove 51 extending in the front-rear direction is formed in an area between the front and rear guide grooves 50F, 50R at a laterally central position of the lower surface of the upper wall portion 24. A front end part of the receiving groove 51 is connected at a right angle to a lower end part of the front guide groove 50F, and a rear end part of the receiving groove 51 is connected at a right angle to a lower end part of the rear guide groove 50R.

<Second Member 34>

The second member 34 is a single component made of synthetic resin. The second member 34 includes a base plate portion 35 elongated in the front-rear direction and a pair of left and right side wall portions 36 extending upward from both left and right side edges of the base plate portion 35. Lock portions 38 (see FIG. 8) are formed by recessing the inner side surfaces of the pair of side wall portions 36 in a stepped manner.

The second member 34 includes a front separation wall portion 37F and a rear separation wall portion 37R extending upward at a right angle from a laterally central position of the base plate portion 35. A space for avoiding interference with the center partition wall 27 of the first member 23 when the first and second members 23, 34 are united is formed between the front and rear separation wall portions 37F, 37R. The front and rear separation wall portions 37F, 37R exhibit a short circuit preventing function by being interposed between the pair of female inner conductors 15 like a partition.

In a plan view, the front separation wall portion 37F extends rearward from a position slightly behind the front end of the base plate portion 35. In a front view, the front separation wall portion 37F is tapered to have a gradually smaller lateral width toward an upper side (in the uniting direction with the first member 23). A front guide edge part 52F extending in the vertical direction (direction parallel to the uniting direction of the first and second members 23, 34) is formed on the front end surface of the front separation wall portion 37F. A rear guide edge part 52R extending in the vertical direction is formed on the rear end surface of the front separation wall portion 37F.

An upper end edge part (extending end part) of the front separation wall portion 37F serves as a fitting edge part 53 extending in the front-rear direction. The fitting edge part 53 is fit into the receiving groove 51 of the first member 23 when the second member 34 is united with the first member 23. Further, a pair of left and right ribs 54 are formed on both left and right side surfaces (surfaces facing the inner side surfaces of the box-shaped connecting portions 16 when the first and second members 23, 34 are united) of the front separation wall portion 37F. The ribs 54 are disposed on a rear end part (position slightly in front of the rear guide edge part 52R) of the front separation wall portion 37F. In a plan view, the ribs 54 project to approach rear end parts of the box-shaped connecting portions 16 in the lateral direction.

<Assembling of First Member 23 and Second Member 34>

In assembling the first and second members 23, 34, the pair of female inner conductors 15 are placed on the upper wall portion 24 of the vertically inverted first member 23. The pair of female inner conductors 15 are arranged adjacent to each other across the receiving groove 51. The first and second members 23, 34 are divided in the vertical direction orthogonal to the length direction of the female inner conductors 15 and the axes of the front end parts of the wires 20 and united in the vertical direction.

Accordingly, the female inner conductors 15 can be placed while being displaced downward (direction orthogonal to the length direction of the female inner conductors 15) with respect to the first member 23. In this way, untwisted lengths of the wires 20 can be maximally suppressed in the front end parts of the two wires 20 constituting the twisted pair cable 21, wherefore a reduction of a noise reducing function due to the untwisting of the wires 20 can be avoided.

With the pair of female inner conductors 15 placed in the first member 23, the front ends of the box-shaped connecting portions 16 are in contact with or proximately facing the rear surface of the front wall portion 25 and the step portions 18 of the box-shaped connecting portions 16 are locked to the retaining portions 28 from front. Thus, the female inner conductors 15 are positioned with relative displacements in the front-rear direction with respect to the first member 23 restricted. Further, the female inner conductors 15 are prevented from being deviated in position and inclined in the lateral direction by the front end parts of the box-shaped connecting portions 16 being sandwiched between the front side walls 30 and the front partitioning portion 31. The female inner conductors 15 are further prevented from being deviated in position and inclined in the lateral direction by rear end parts of the crimping portions 19 being sandwiched between the rear side walls 32 and the rear partition wall 33.

After the pair of female inner conductors 15 are mounted in the first member 23, the vertically inverted second member 34 is assembled with the first member 23 from above to be united. In the process of uniting the first and second members 23, 34, the front and rear guide edge parts 52F, 52R of the second member 34 are respectively fit into and slide in contact with the front and rear guide grooves 50F, 50R of the first member 23. In this way, it can be prevented that the front separation wall portion 37F is laterally deviated in position to interfere with the box-shaped connecting portion 16.

If the first and second members 23, 34 are united, the female dielectric 22 is configured and, at the same time, the pair of female inner conductors 15 are accommodated and mounted in the female dielectric 22. Further, in the united state, the both front and rear guide edge parts 52F, 52R are kept fit in the both front and rear guide grooves 50F, 50R and the fitting edge part 53 is fit in the receiving groove 51 of the first member 23. Thus, improper lateral deformation of the front separation wall portion 37F is prevented. The united first and second members 23, 34 are held united by the locking of the lock portions 38 and the lock projections 29. In the above way, the assembling of the terminal unit 13 is completed.

With the first and second members 23, 34 united, the front side walls 30, the side wall portions 36 and the rear side walls 32 are disposed one after another in rows, and the front partitioning portion 31, the front separation wall portion 37F, the center partition wall 27, the rear separation wall portion 37R and the rear partition wall 33 are disposed one after another in a row. In this way, a pair of left and right conductor accommodation chambers 39 are configured inside the female dielectric 22. The pair of female inner conductors 15 are individually accommodated in the pair of conductor accommodation chambers 39 while being laterally arranged in parallel.

<Outer Conductor 14>

The terminal unit 13 is surrounded by the outer conductor 14 in the form of a rectangular tube made of a metal material. The outer conductor 14 is composed of the upper shell 55 and a lower shell 56. The upper shell 55 is formed with a first locking recess 57A, second locking recesses 57B, third locking recesses 57C and a barrel portion 40. In assembling the outer conductor 14 with the terminal unit 13, the upper and lower shells 55, 56 are fit and united to vertically sandwich the terminal unit 13.

If the outer conductor 14 is assembled with the terminal unit 13, the shield terminal 12 is configured. With the outer conductor 14 assembled with the terminal unit 13, the first, second and third locking recesses 57A, 57B and 57C of the upper shell 55 are respectively independently locked to the first, second and third locking portions 49A, 49B and 49C of the first member 23, whereby the upper shell 55 is held assembled with the terminal unit 13 (first member 23). The barrel portion 40 is fixed to a braided wire 41 of the twisted pair cable 21. The shield terminal 12 fixed to the twisted pair cable 21 is assembled by being inserted into the housing 11 from behind.

The shield terminal 12 and the terminal unit 13 of this embodiment are used in the high-speed communication circuit. The female inner conductors 15 and the male inner conductors 48 are connected by inserting the tabs 48T into the box-shaped connecting portions 16. Since metals overlap in parts where the tabs 48T are inserted in the box-shaped connecting portions 16, impedances are lower than other parts (crimping portions 19 of the female inner conductors 15 to be connected to the wires 20). To enhance the reliability of communication performance, the impedances of connected parts of the box-shaped connecting portions 16 and the tabs 48T need to be matched with impedances of the other parts.

In this embodiment, a dielectric constant of the front separation wall portion 37F interposed between the pair of box-shaped connecting portions 16 is reduced as an impedance matching means. However, since a resin material having a low dielectric constant and a high mechanical strength is generally expensive, a material cost increases if the entire female dielectric 22 is made of the resin material having a low dielectric constant and a high mechanical strength. Accordingly, in this embodiment, the female dielectric 22 is divided into two members, i.e. the first and second members 23, 34, the second member 34 formed with the front separation wall portion 37F is made of polypropylene having a low dielectric constant and a low mechanical strength and the first member 23 is made of polybutylene terephthalate having a higher dielectric constant than the second member 34, but relatively inexpensive. In this way, the material cost is suppressed.

Further, since the front separation wall portion 37F is tapered to become gradually narrower toward the upper side (wedge-shaped), air layers 58 are formed between the outer side surfaces of the front separation wall portion 37F and the inner side surfaces of the box-shaped connecting portions 16. Since air has a very low dielectric constant, the impedances in the connected parts of the box-shaped connecting portions 16 and the tabs 48T are enhanced by disposing these air layers 58 to correspond to the box-shaped connecting portions 16.

Note that if the air layers 15 are present between the front separation wall portion 37F and the box-shaped connecting portions 16, there is a concern that the female inner conductors 15 are displaced to be inclined toward the front separation wall portions 37F. However, since the front separation wall portion 37F is formed with the ribs 54 projecting toward the box-shaped connecting portions 16, the female inner conductors 15 are not inclined toward the front separation wall portion 37F.

There is a concern for an impedance reduction since the upper wall portion 24 of the first member 23 having a high dielectric constant is proximately facing the upper surfaces of the box-shaped connecting portions 16. As a countermeasure against this, a pair of left and right front first air chambers 42 are formed in the front end part of the upper wall portion 24, and a pair of left and right rear first air chambers 43 are formed at positions behind and near the pair of front first air chambers 42 in the upper wall portion 24.

Any of these first air chambers 42, 43 is located in an area corresponding to the box-shaped connecting portions 16 in the front-rear direction (length direction of the female inner conductors 15). An area of the upper wall portion 24 between the front first air chambers 42 and the rear first air chambers 43 functions as a reinforcing portion 44.

Further, a pair of left and right front second air chambers 45 are formed in the front end part of the base plate portion 35 of the second member 34, and a pair of left and right rear second air chambers 46 are formed at positions behind and near the pair of front second air chambers 45 in the base plate portion 35. Any of these second air chambers 45, 46 is located in an area corresponding to the box-shaped connecting portions 16 in the length direction of the female inner conductors 15. An area of the base plate portion 35 between the front second air chambers 45 and the rear second air chambers 46 functions as a reinforcing portion 47.

The shield terminal 12 of this embodiment includes the pair of female inner conductors 15 and the female dielectric 22. Each female inner conductor 15 includes the box-shaped connecting portion 16 into which the tab 48T of the male inner conductor 48 is inserted. The female dielectric 22 is configured by uniting the first member 23 and the second member 34 made of the material having a lower dielectric constant than the first member 23. The pair of female inner conductors 15 are accommodated in the female dielectric 22 while being laterally arranged in parallel.

The female dielectric 22 is divided into the first and second members 23, 34 having different dielectric constants and the second member 34 having a lower dielectric constant is formed with the front separation wall portion 37F. The front separation wall portion 37F is disposed to partition between the pair of box-shaped connecting portions 16, thereby enhancing the impedances in the connected parts of the box-shaped connecting portions 16 and the tabs 48T for impedance matching over the entire lengths of the female inner conductors 15. According to this configuration, the material cost can be reduced as compared to the case where the second member 34 is made of a resin material having a low dielectric constant and a high mechanical strength. Further, since a material having a high dielectric constant generally has a relatively high mechanical strength, strength is ensured for the entire female dielectric 22 by using the first member 23 having a higher dielectric constant than the second member 34. Since the first member 23 is formed with a part required to have a mechanical strength to hold the female inner conductors 15, the female inner conductors 15 can be reliably held.

Further, the front separation wall portion 37F is cantilevered from the base plate portion 35 constituting the second member 34, and the first member 23 is formed with the receiving groove 51 into which the extending end part (fitting edge part 53) of the front separation wall portion 37F is fit. Since a material having a low dielectric constant generally has a low mechanical strength, there is a concern for the deformation of the front separation wall portion 37F due to interference with the female inner conductors 15.

However, since the extending end part (fitting edge part 53) of the front separation wall portion 37F is fit into the receiving groove 51 of the first member 23 having a relatively high mechanical strength, improper lateral deformation of the front separation wall portion 37F can be prevented. Further, since a creepage distance between the female inner conductors 15 becomes longer by an area where the outer surface of the front separation wall portion 37F and the inner surface of the receiving groove 51 face each other, insulation performance is also excellent.

Further, the front separation wall portion 37F extends in the uniting direction with the first member 23 from the base plate portion 35 constituting the second member 34, and the first member 23 is formed with the front and rear guide grooves 50F, 50R to be brought into sliding contact with the front separation wall portion 37F in the process of uniting with the second member 34. According to this configuration, in the process of uniting the first and second members 23, 34, improper deformation of the front separation wall portion 37F can be prevented by bringing the both front and rear guide edge parts 52F, 52R of the front separation wall portion 37F into contact with the both front and rear guide grooves 50F, 50R.

Further, the front separation wall portion 37F is cantilevered from the base plate portion 35 constituting the second member 34 and becomes gradually thinner in an extending direction. According to this configuration, the interference of the front separation wall portion 37F with the box-shaped connecting portions 16 can be avoided in the process of uniting the first and second members 23, 34. Further, since the air layers 58 having a low dielectric constant are formed between the front separation wall portion 37F and the box-shaped connecting portions 16, impedances of the box-shaped connecting portions 16 are enhanced.

Further, if the air layers 58 are present between the front separation wall portion 37F and the box-shaped connecting portions 16, there is a concern that the female inner conductors 15 are improperly inclined toward the front separation wall portion 37F. Accordingly, the front separation wall portion 37F is formed with the ribs 54 projecting toward the female inner conductors 15 from the surfaces of the front separation wall portion 37F facing the box-shaped connecting portions 16. In this way, even if the female inner conductor 15 is going to be inclined toward the front separation wall portion 37F, the inclination of the female inner conductor 15 can be suppressed by contact with the rib 54. Further, the strength of the front separation wall portion 37F is enhanced by the ribs 54.

Further, the front wall portion 25 of the female dielectric 22 is formed with the insertion openings 26 through which the tabs 48T of the male inner conductors 48 are inserted. There is a concern that the tab 48T is pierced into the front surface of the front wall portion 25 if the tab 48T is deviated in position in the vertical or lateral direction. Accordingly, focusing on the fact that the first member 23 made of the material having a higher dielectric constant than the second member 34 also has a higher mechanical strength than the second member 34, the front wall portion 25 is formed on the first member 23. In this way, the mechanical strength of the front wall portion 25 is enhanced, wherefore even if the tab 48T deviated in position from the insertion opening 26 butts against the front wall portion 25, the tab 48T is not pierced into the front wall portion 25.

Further, the first member 23 is formed with the locking portions 49A, 49B and 49C for holding the female dielectric 22 and the outer conductor 14 in the assembled state by being locked to the outer conductor 14 (upper shell 55). Since the first member 23 formed with the locking portions 49A, 49B and 49C has a high mechanical strength, the locking portions 49A, 49B and 49C are not improperly deformed even if being locked to the outer conductor 14 (upper shell 55) made of the metal material. In this way, the female dielectric 22 and the outer conductor 14 can be reliably held in the assembled state.

Further, the air chambers 42, 43, 45 and 46 are formed in the upper wall portion 24 and the base plate portion 35 constituting the conductor accommodation chambers 39 of the female dielectric 22 as a means for enhancing the impedances of the connected parts of the box-shaped connecting portions 16 and the tabs 48T. Since the dielectric constant of air is lower than that of synthetic resin as the material of the female dielectric 22, it is realized to enhance the impedances by forming the air chambers 42, 43, 45 and 46.

Further, the front and rear first air chambers 42, 43 of the upper wall portion 24 are disposed only in an area of the upper wall portion 24 in front of the retaining portions 28 (i.e. area corresponding to the box-shaped connecting portions 16 in the front-rear direction). In this way, it could be realized to dispose the air chambers 42, 43 in the area corresponding to the box-shaped connecting portions 16 while the retaining portions 28 serving as a means for retaining the female inner conductors 15 were formed on the upper wall portion 24.

Other Embodiments

The present invention is not limited to the above described and illustrated embodiment. For example, the following embodiments are also included in the technical scope of the present invention.

(1) Although the separation wall portion is divided into the front and rear separation wall portions in the above embodiment, the separation wall portion may be in the form of one wall.

(2) Although the first member is formed with the receiving groove in the above embodiment, the first member may include no receiving groove.

(3) Although the first member is formed with the guide grooves in the above embodiment, the first member may include no guide groove.

(4) Although the front separation wall portion is formed to become gradually thinner in the extending direction in the above embodiment, the front separation wall portion may have a constant thickness in the entire area in the extending direction.

(5) Although the front separation wall portion is formed with the ribs in the above embodiment, the front separation wall portion may include no rib.

(6) Although the front wall portion is provided on the first member (member made of the material having a higher dielectric constant than the second member) in the above embodiment, the front wall portion may be provided on the second member.

(7) Although the first and second members are formed with the air chambers in the above embodiment, the first and second members may include no air chamber.

(8) Although the two wires connected to the pair of female inner conductors constitute the twisted pair cable in the above embodiment, the present invention can be applied also when the wires connected to the female inner conductors do not constitute a twisted pair cable.

(9) Although two female inner conductors are accommodated in one female dielectric in the above embodiment, three or more female inner conductors may be accommodated in one female dielectric.

(10) Although the female dielectric is composed of two components, i.e. the first and second members in the above embodiment, a female dielectric may be composed of three or more members including the first and second members.

(11) Although the first member is made of polybutylene terephthalate (PBP) in the above embodiment, the first member may be made of a material other than polybutylene terephthalate.

(12) Although the second member is made of polypropylene (PP) in the above embodiment, the second member may be made of polyethylene (PE), polystyrene (PS), foamed polybutylene terephthalate or the like.

(13) Although a combination of the materials of the first and second members is polybutylene terephthalate and polypropylene in the above embodiment, the combination of the materials of the first and second members may be polybutylene terephthalate and polypropylene (PP) or polybutylene terephthalate and foamed polybutylene terephthalate.

List of Reference Signs

| | |
|---|---|
| 12 | shield terminal |
| 14 | outer conductor |
| 15 | female inner conductor |
| 16 | box-shaped connecting portion |
| 22 | female dielectric |
| 23 | first member |
| 25 | front wall portion |
| 26 | insertion opening |
| 34 | second member |
| 35 | base plate portion |
| 37F | front separation wall portion (separation wall portion) |
| 48 | male inner conductor |
| 48T | tab |
| 49A | first locking portion (locking portion) |
| 49B | second locking portion (locking portion) |
| 49C | third locking portion (locking portion) |
| 50F | front guide groove (guide groove) |
| 50R | rear guide groove (guide groove) |
| 51 | receiving groove |
| 54 | rib |

The invention claimed is:

1. A shield terminal, comprising:

a pair of female inner conductors including box-shaped connecting portions into which tabs of male inner conductors are inserted;

a female dielectric configured by uniting a first structure and a second structure made of a material having a lower dielectric constant than the first structure, the pair of female inner conductors being accommodated in the female dielectric while being arranged in parallel;

a separation wall portion formed in the second structure, the separation wall portion being disposed to partition between a pair of the box-shaped connecting portions; and a front wall portion formed on the first structure, the front wall portion including insertion openings through which the tabs are inserted, wherein:

air layers are formed between outer side surfaces of the separation wall portion and inner side surfaces of the box-shaped connecting portions, and ribs projecting toward the box-shaped connecting portions are formed on the separation wall portion.

2. The shield terminal according to claim 1, further comprising a locking portion formed on the first structure, the locking portion holding the female dielectric and an outer conductor in an assembled state by being locked to the outer conductor.

3. A shield terminal, comprising:

a pair of female inner conductors including box-shaped connecting portions into which tabs of male inner conductors are inserted;

a female dielectric configured by uniting a first structure and a second structure made of a material having a lower dielectric constant than the first structure, the pair of female inner conductors being accommodated in the female dielectric while being arranged in parallel;

a separation wall portion formed in the second structure, the separation wall portion being disposed to partition between a pair of the box-shaped connecting portions; and a front wall portion formed on the first structure, the front wall portion including insertion openings through which the tabs are inserted, wherein:

the separation wall portion is cantilevered from a base plate portion of the second structure, and the first structure is formed with a receiving groove into which an extending end part of the separation wall portion is fit.

4. The shield terminal according to claim 3, further comprising ribs formed on the separation wall portion, the ribs projecting from surfaces of the separation wall portion facing the box-shaped connecting portions.

5. The shield terminal according to claim 3, further comprising a locking portion formed on the first structure, the locking portion holding the female dielectric and an outer conductor in an assembled state by being locked to the outer conductor.

6. A shield terminal, comprising:

a pair of female inner conductors including box-shaped connecting portions into which tabs of male inner conductors are inserted;

a female dielectric configured by uniting a first structure and a second structure made of a material having a lower dielectric constant than the first structure, the pair of female inner conductors being accommodated in the female dielectric while being arranged in parallel;

a separation wall portion formed in the second structure, the separation wall portion being disposed to partition between a pair of the box-shaped connecting portions; and a front wall portion formed on the first structure, the front wall portion including insertion openings through which the tabs are inserted, wherein:

the separation wall portion extends in a uniting direction with the first structure from a base plate portion of the second structure, and the first structure is formed with a guide groove to be brought into sliding contact with the separation wall portion in a process of uniting with the second structure.

7. The shield terminal according to claim 6, further comprising ribs formed on the separation wall portion, the ribs projecting from surfaces of the separation wall portion facing the box-shaped connecting portions.

8. The shield terminal according to claim 6, further comprising a locking portion formed on the first structure, the locking portion holding the female dielectric and an outer conductor in an assembled state by being locked to the outer conductor.

9. A shield terminal, comprising:

a pair of female inner conductors including box-shaped connecting portions into which tabs of male inner conductors are inserted;

a female dielectric configured by uniting a first structure and a second structure made of a material having a lower dielectric constant than the first structure, the pair of female inner conductors being accommodated in the female dielectric while being arranged in parallel;

a separation wall portion formed in the second structure, the separation wall portion being disposed to partition between a pair of the box-shaped connecting portions; and a front wall portion formed on the first structure, the front wall portion including insertion openings through which the tabs are inserted, wherein the separation wall portion is cantilevered in a uniting direction with the first structure from a base plate portion of the second structure and becomes gradually thinner in an extending direction.

10. The shield terminal according to claim 9, further comprising ribs formed on the separation wall portion, the ribs projecting from surfaces of the separation wall portion facing the box-shaped connecting portions.

11. The shield terminal according to claim 9, further comprising a locking portion formed on the first structure, the locking portion holding the female dielectric and an outer conductor in an assembled state by being locked to the outer conductor.

* * * * *